US005787521A

United States Patent [19]

O'Connell et al.

[11] Patent Number: 5,787,521

[45] Date of Patent: Aug. 4, 1998

[54] REMOTELY OPERATED PLUG

[75] Inventors: Cavan J. O'Connell; Albert E. Worthington, both of Christchurch, New Zealand

[73] Assignee: Wes Wastes Limited, Christchurch, New Zealand

[21] Appl. No.: 726,078

[22] Filed: Oct. 4, 1996

Related U.S. Application Data

[63] Continuation of PCT/NZ96/00031 Apr. 11, 1996.

[30] Foreign Application Priority Data

| | | | |
|---|---|---|---|
| Apr. 11, 1995 | [NZ] | New Zealand | 270911 |
| Jul. 12, 1995 | [NZ] | New Zealand | 272545 |
| Oct. 31, 1995 | [NZ] | New Zealand | 280355 |
| Dec. 11, 1995 | [NZ] | New Zealand | 280644 |

[51] Int. Cl.[6] ..... E03C 1/23

[52] U.S. Cl. ..... 4/689

[58] Field of Search ..... 4/688–693

[56] References Cited

U.S. PATENT DOCUMENTS

| | | | |
|---|---|---|---|
| 645,639 | 3/1900 | Bunting | 4/690 |
| 1,980,250 | 11/1934 | Baxter | 4/690 |
| 3,002,196 | 10/1961 | Mackey | 4/689 |
| 4,192,026 | 3/1980 | Williams . | |

OTHER PUBLICATIONS

EP, 395121, A (Kohler Co.) Oct. 31, 1990.
EP, 288731, A (Ohta) Nov. 2, 1988.
DE, 3108791, A (Gerberit AG) Dec. 24, 1981.
FR, 2643097, A (Piat) Aug. 17, 1990.
FR, 2582032, A (Dalphinet) Nov. 21, 1986.
AU, 34230/95, A (Fleischer) Apr. 26, 1996.
NZ, 116617 (Simon Metal Products Limited) Feb. 27, 1958.

*Primary Examiner*—Charles E. Phillips
*Attorney, Agent, or Firm*—Seed and Berry LLP

[57] ABSTRACT

A remotely operated plug unit (13) for use in a sink or basin (12) with a sink waste unit (11). The drain pipe requires minor modification, by the insertion of two holes (18, 19) opposite one another part way down the threaded sides (17). The plug (13) is spring biassed to an open position and retained in a closed position by two pins (31, 34). The second pin 34 is remotely activated (by cabling (14)) by an actuator (44) and opening mechanism (15). The plug (13) is closed manually by direct downward pressure on the top of the plug (13). All components for operation of the plug (13) which are contained within the sink waste unit (11) are circumferentially positioned. Three preferred embodiments of the opening mechanism (15) are disclosed (two being capable of incorporation in a tap for the sink (12)). Various embodiments in the manner of operation of the plug (13) are also disclosed.

16 Claims, 7 Drawing Sheets

REMOTELY OPERATED PLUG

CROSS REFERENCE TO RELATED APPLICATION

This application is a continuation of International Application Ser. No. PCT/NZ96/00031, with an international filing date of Apr. 11, 1996, currently pending.

TECHNICAL FIELD

The present invention relates to an improved remotely operated plug for a commercial or domestic baths, sinks or basins. The invention allows the plug to remain in the drain outlet of the sink or basin.

BACKGROUND ART

Remotely operated plugs to open and close plugs in drains of a sink or basin are known. An example of such a plug is shown in FIG. 1. The plug 3 sits with its shaft 4 centred by a guiding collar 5. A flange 7 is secured about pivot point 8 and operates in the direction shown by Arrow A. The plug 3 is pushed into position manually which pushes the flange 7 into an open position by pivoting about pivot point 8. The plug 3 then sits inside the retaining drain. A cable (not shown) from a manually turned button (not shown) operates the flange 7 via pivot point 8 to push the shaft 4 up when the user of the basin wishes to empty water down the drain. Examples of this style of design can be seen in U.S. Pat. Nos. 1,984,950 (Steen), and 2,137,496 (Klein).

Alternatively, the button can be pulled and the connection between the button and the plug is by rigid connection rods. Examples of this style of design can be seen in U.S. Pat. Nos. 3,080,570, 4,596,057 (Ohta), 5,333,327 (Redding), 3,314,085 (Minella).

The action in an upward direction of the flange 7 pushes up the shaft 4 and the plug 3 to leave an area free for water to flow. Of necessity the water must flow down and about the collar 5, which is held in position by links 9. A sieve may be placed about the links 9 about the plug 3, if so desired. However the links 9 themselves can indirectly act as a sieve for any extraneous material entering the drain.

The disadvantages of the above system are as follows: the collar 5 and links 9 are centrally positioned in the drain and all material flowing through the drain must pass this mechanism and the flange 7. Thus this area can get extremely dirty and retain material which would require the area to be regularly cleaned in order to maintain a reasonably standard of hygiene. However the underside of these elements is almost impossible to reach. Secondly, the linkages between the operator and the pivot point 8, where they are connecting rods, are rigid. This can limit both the distance between the point of operation of the plug and the plug itself, the spacial relationship of the two points, and also mean that considerable volume or space must be assigned for these linkages. Allowing such a space behind the basin or in relation to a basin can sometimes be a constraint on design. Also, in some circumstances it can be very difficult to push the plug 3 up against the volume of water in the basin as the force conveyed by the linkages and the manner of operation of the flange 7 is not great. Also if the plug 3 is to be one that is not manually removable, further mechanical parts are required to be centrally positioned within the drain in order that the plug can be retained whilst permitting it to move up and down within the collar 5.

Other known items of prior art vary in the manner in which the flange is positioned. However all operate on the basic theme that the flange and control of the plug is centrally positioned within the waste pipe. Examples of alternative remote activation units to those given above include U.S. Pat. No. 4,876,749, New Zealand Patent No. 116617.

DISCLOSURE OF INVENTION

An object of the present invention is the provision of a remotely operated plug which overcomes the disadvantages of all of the above described prior art, whilst at the same time provides a remotely operated plug requiring a minimum of modification to existing drains, basins and any associated taps.

The present invention provides a remotely operated plug assembly for a sink or basin with a drain, said plug assembly including:

a sink waste unit secured within said drain, which sink waste unit includes a drain pipe;

a plug movably and releasably secured within said drain, said plug including a spring and an inter-engaging means, said plug having a closed top and sides with holes formed therein, wherein said plug is movably secured within the drain by said inter-engaging means which permits vertical movement of said plug within said drain, between an open and a closed position (and vice versa), but which does not permit the removal of said plug from said drain under normal operating conditions, and said spring being to bias said plug to the open position, said open positing being a position in which said holes are open to said sink or basin, and said closed position being a position in which said closed top is substantially flush with the top of said sink waste unit;

an opening mechanism to move the plug from the closed position to the open position, said mechanism being situated remotely from said drain and plug and connected by cabling to a retaining mechanism, said opening mechanism including an opening means to move and retain one end of said cabling;

the retaining mechanism, to keep said plug in the closed position, includes spring-biassed means to release said retaining mechanism to allow said plug to move to the open position;

means to allow the plug to be physically removed from said drain and replaced therein; and wherein said plug is capable of movement between the open and the closed positions by manual depression of said plug, and between the closed and the open positions by operation of said remotely placed opening mechanism to release the retaining mechanism via the cabling; and wherein said inter-engaging means, and the elements of said retaining means being circumferential about said drain and plug, are circumferentially situated within said drain pipe or about said drain pipe.

The present invention further provides a remotely operated plug for a sink or basin with a drain and a drain pipe, wherein said plug includes:

being movably and releasably secured within said drain, said plug having a closed top and sides with holes formed therein, said plug being movably secured within the drain by an inter-engaging means which permits vertical movement of said plug within said drain, between an open and a closed position (and vice versa), but which does not permit the removal of said plug from said drain under normal operating conditions and which incorporates a spring to bias said plug to the open position, said open position being a position in which said holes are open to said sink or basin, and said closed position being a position in which said closed top is substantially flush with the top of said sink waste unit;

said plug being connected to an opening mechanism situated remotely from said drain and plug unit and connected by cabling to a retaining mechanism, said opening mechanism including an opening means to move and retain one end of said cabling;

the retaining mechanism, to keep said plug in the closed position, including spring-biassed means to release said retaining mechanism to allow said plug to move to the open position;

said plug including means for enabling the plug to be physically removed from said drain and replaced therein; and wherein said plug is capable of movement between the open and the closed positions by manual depression of said plug, and between the closed and the open positions by operation of said remotely placed opening mechanism to release the retaining mechanism via the cabling; and wherein said inter-engaging means, and the elements of said retaining means which are on or about said drain and plug, are circumferentially situated within said drain pipe or about said drain pipe.

BRIEF DESCRIPTION OF DRAWINGS

By way of example only a preferred embodiment of the present invention will be described in detail with reference to the accompanying drawings, in which.

BEST MODE OF CARRYING OUT THE INVENTION

Figure 1:
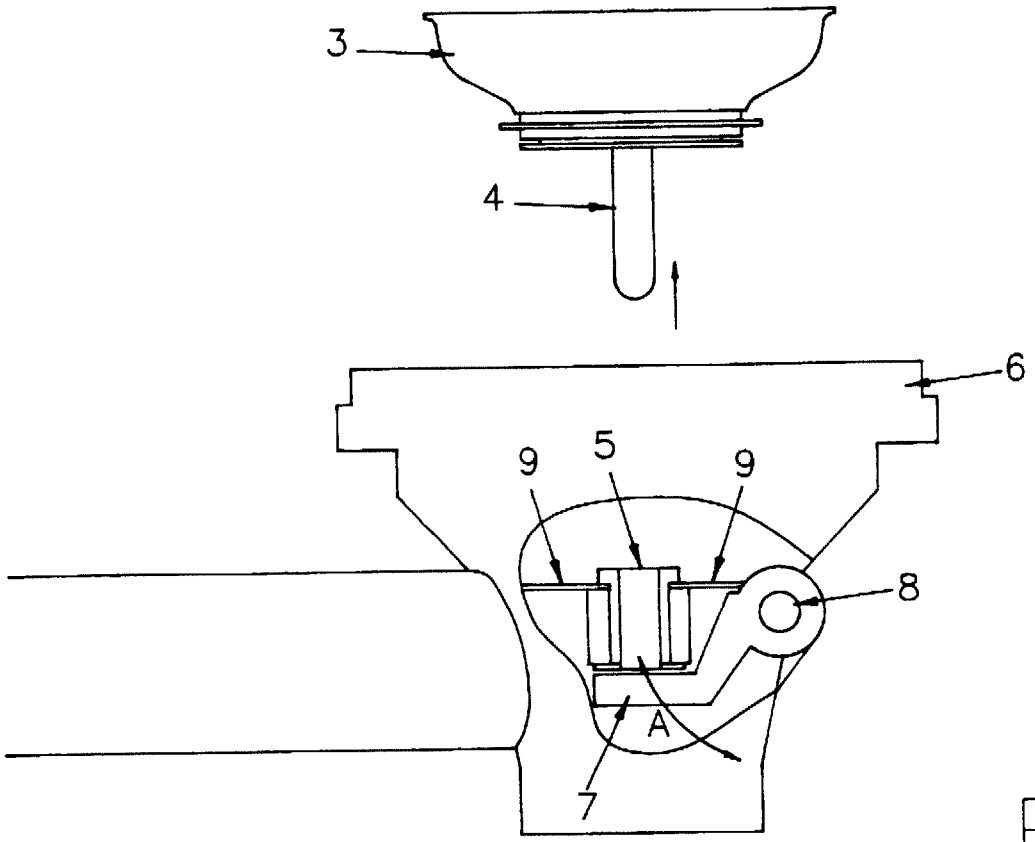
FIG. 1 is a section view of a remotely operated plug of prior art.
Figure 2:
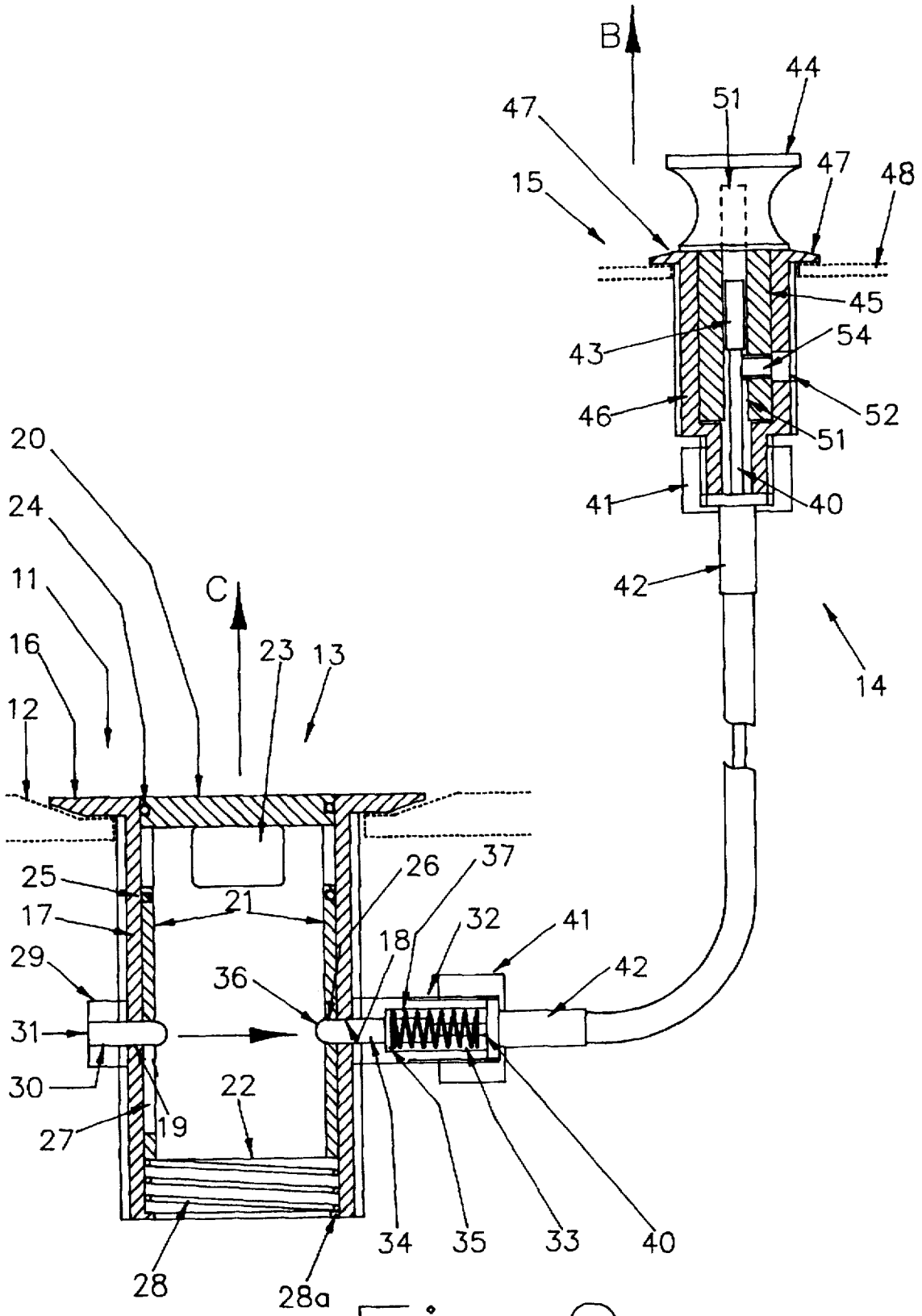
FIG. 2 is a section view of a first preferred embodiment of the present invention with the plug in the closed position.
Figure 3:
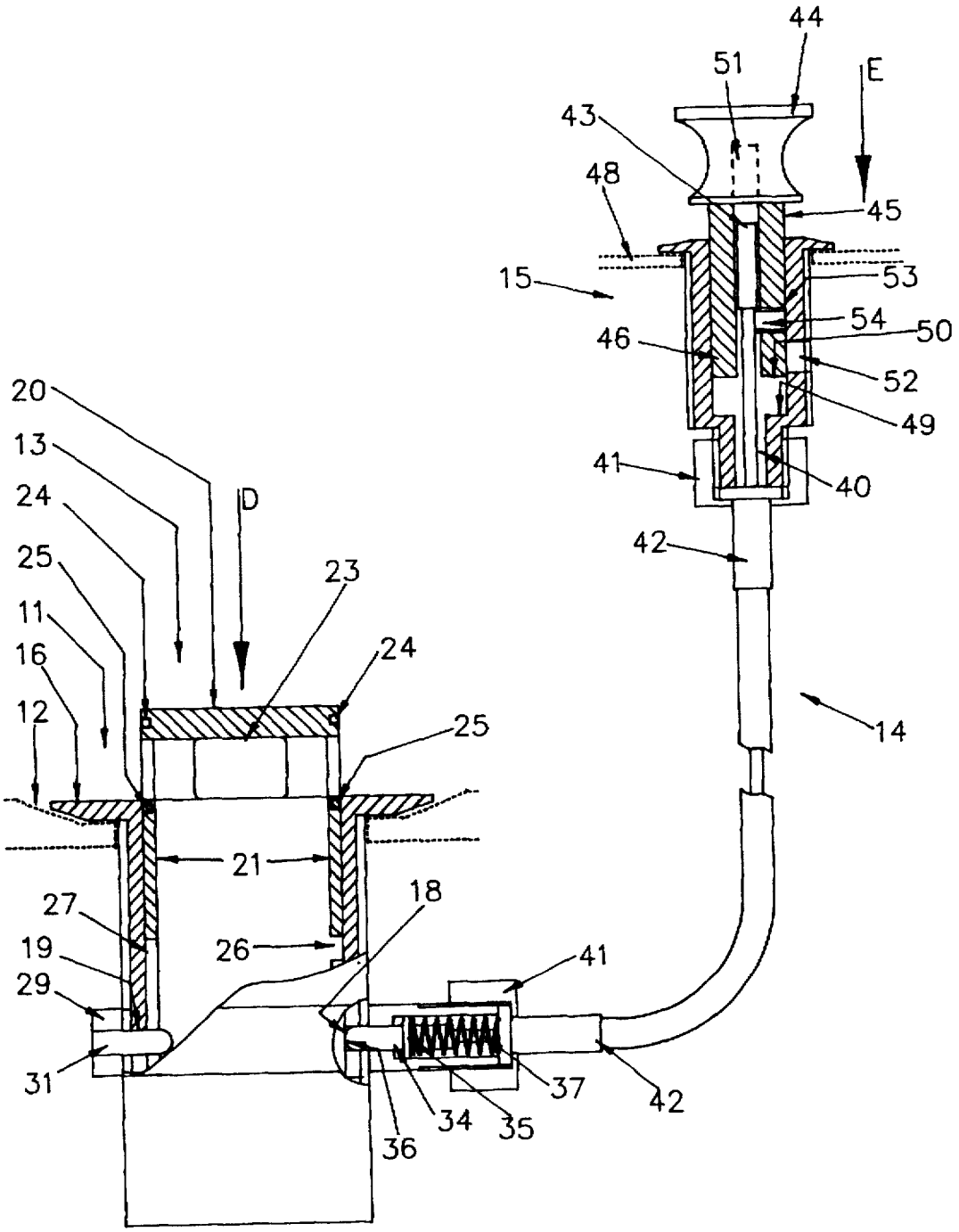
FIG. 3 is a partial section view of the first preferred embodiment of the present invention with the plug in the open position.

The prior art shown in FIG. 1 has been discussed above. Referring to FIGS. 2 and 3, the first preferred embodiment of the present invention incorporates a sink waste unit 11 fitting in the base of a standard basin or sink 12. The sink waste unit 11 incorporates a plug 13 described below. The plug 13 is connected by cabling 14 to the remote opening unit 15.

The sink waste unit 11 includes a known drain of standard type with a flange 16 which sits in a specially moulded portion of the sink 12 or slightly proud of the surface of the base of the sink 12 adjacent the opening for the sink waste unit 11. The cylindrical sides 17 (forming the drain pipe) of the sink waste unit 11 are screw-threaded on the outside, in known manner.

On the sides 17 two circular first and second holes 18, 19 are positioned on a common plane and opposite one another. The first and second holes 18, 19 are approximately half way up the length of the sink waste unit 11, but this positioning may vary depending on the depth of the wall of the sink base 12 and other factors to be discussed below. The holes (18, 19) need not be opposite each other, but only spaced apart, if so desired.

The plug 13 incorporates a top 20, sides 21, and bottom 22. The upper portions of the sides 21, adjacent the top 20, are slotted with draining holes 23. The draining holes 23 may be of approximately rectangular or square in shape. Alternatively the holes 23 may be slots, sufficient for water to drain through. Positioned either side of the draining holes 23, on the circumference of the sides 21, are two O-rings 24, 25. O rings 24, 25 are positioned in respective grooves, in order that they provide a seal between the sides 17 of the sink waste unit 11 and the sides 21 of the plug 13. O-ring 24, positioned in the side 21 adjacent the top 20, can be seen when the plug 13 is in the open position (FIG. 3). O-ring 25 is hidden from view at all times the plug 13 is in the sink waste unit 11, but can be seen when the plug 13 is removed from the sink waste unit 11.

O-ring 25 is positioned adjacent the top of the sink waste uuit 11 when the plug 13 is open.

Thus waste water drains from the sink through holes 23, into the interior of the plug 13, and out through the bottom 22 into the drain pipe (not shown) below the plug 13.

A circular plug hole 26, of the same dimensions as first and second holes 18, 19 in the sink waste unit 11, is positioned on the side 21 of the plug 13. When the plug 13 is in the closed positioned (FIG. 2) the first hole 18 and plug hole 26 are aligned.

A slot 27 is positioned in and through the side 21 of the plug 13. The slot 27 is adjacent the bottom 22. The slot 27 is also positioned approximately opposite the plug hole 26. The slot 27 is positioned and dimensioned so one has a clear hole through the sink waste unit 11 and the plug 13 from the outside to the interior of the plug 13 whether the plug 13 is in the open or the closed position. The length of the slot 27 is determined by the desired height of the plug 13 above the drain flange 16. The slot 27 is closed at its bottom end.

A spring 28 of a diameter approximately equal to that of the plug 13 is positioned below the plug 13 between the bottom 22 of the plug 13 and the bottom of the sink waste unit 11. It is held in position by known means, for example a circular flange **28*a* at the bottom of the drain walls 17. The spring 28 could be any known spring means for retaining the plug 13** in the open position.

A circular collar 29, which is screw-threaded on the inside, is positioned about the outside of the sink waste unit 11. The collar 29 is screw-threaded up the sink waste unit 11 to be positioned about or over the first and second holes 18, 19. A shaft (not shown) through the collar 29 is machined to enable a metal pin 31 to be positioned therein. The pin 31 is of sufficient length that it can be inserted through the second hole 19 in the sink waste unit 11 and protrudes through the slot 27. Thus the position of the pin 31 with the slot 27 in the plug 13 operates to keep the plug 13 from rotating within the sink waste unit 11. If so desired, the pin 31 can be replaced with a bolt or grub screw so the unit 13 can be disassembled more easily.

Diametrically opposite the pin 31 on the collar 29, and integrally formed with the collar 29 is a threaded cylinder 32. The cylinder 32 contains a cylindrical chamber 33. The chamber 33 is contiguous with a circular hole (not shown) through to the interior of the collar 29. A second pin 34, with a flange 35 remote from each end of the pin 34 is positioned such that the flange 35 remains within the chamber 33. The second pin 34 is dimensioned so that one end 36 moves through the plug hole 26, first drain hole 18 and cylinder 32. The arcuate or shaped end 36 of the second pin 34, when in its extended position, protrudes slightly through the drain sides 21. The holes 18, 19 in the sink waste unit 11, the hole 26 and slot 27 in the plug 13 and pins 31, 34 form an inter-engaging means permitting the vertical movement of the plug 13 within the sink waste unit 11. The chamber 33 encloses a fine spring 37. The fine spring 37 operates against the flange 35 of the second pin 34. The fine spring 37 can be any known spring-biased means. The flange 35, chamber 33, fine spring 37, cable wire 40, cylinder 32, nut 41 and sleeve 42 form part of a retaining mechanism. Also forming part of the retaining mechanism (to keep the plug 13 in the closed position) are holes 18 and 26 and pin 34 which are also components of the inter-engaging means. Secured to the second end of the second pin 34 is a cable wire 40. The cable wire 40 runs within the cabling 14 between the plug 13 and the remote opening unit 15. The cabling 14 is secured to the collar 29 and cylinder 32 by a nut 41 and threaded sleeve 42, in known manner. The spring 37 operates against the inside of the nut 41, in addition to the flange 35 of the second pin 34. The spring 37 may also be contained at the second end of the cable wire 40.

The second end of the cable wire 40 is secured within the remote opening unit 15 to an end collar 43. The end collar 43 is of a diameter greater than that of the cable wire 40. The end collar 43 is cylindrical and circular in cross section.

The remote opening unit 15 (forming the opening means of the opening mechanism for the plug 13) further includes a hand knob 44 with attached hollow shaft 45, a protective sleeve 46, and nut 41 and attendant sleeve. The lower, hidden first end of the protective sleeve 46 is of a cross-sectional diameter that is smaller than that of the bulk of the sleeve 46 and is screw-threaded to received thereon the nut and sleeve (41, 42) at the second end of the cabling 14. The upper, second end of the protective sleeve 46 is shaped with a flange 47. The shaping of the flange 47 is complementary with the shape of the base 48 into or onto which the remote opening unit 15 is positioned and/or secured (for example, the flat space between two taps or beside one tap, for a basin).

The interior of the protective sleeve 46 is hollow and stepped with a shoulder 49 (FIG. 3) on which the bottom 50 of the shaft 45 of the knob 44 rests, when the hand knob 44 is touching the top of the flange 47 of the protective sleeve 46.

The interior of the shaft 45 of the hand knob 44 is hollow with a uniform bore 51 therethrough which extends into the hand knob 44. A transverse circular hole 52 in the protective sleeve 46 is positioned to be aligned with a smaller sized transverse circular hole 53 through the shaft 45. The shaft hole 53 and sleeve hole 52 are positioned such that when the knob 44 is touching the flange 47, the two holes 53, 52 are aligned. A holding pin 54 is positioned within shaft hole 53 such that it protrudes into the bore 51 and touches the cable wire 40. The holes 52 and 53 and holding pin 54 are positioned such that they are below the end collar 43 connected to the cable wire 40.

The above described remote opening unit 15 operates in the following manner: the plug 13 can be pushed down into a closed position by a thumb or other means (Arrow D, FIG. 3). Once the plug 13 is at its lowest position and the top 20 of the plug 13 is flush with the top of the drain flange 16, the plug hole 26 is aligned with the second drain hole 19 and the retaining mechanism operates such that the biased fine spring 37 pushes the second pin 34 through both holes (19, 26) to hold the plug 13 in the closed position. Part of the interengaging means, the first pin 31, is then at the top of the slot 27 and the spring 28 is compressed. This is the closed position of the plug 13 as shown in FIG. 2.

With the plug 13 in this position the remote for the opening mechanism opening unit 15 is as shown in FIG. 2 also. The end collar 43 abuts or is adjacent the holding pin 54. The bottom of shaft 45 rests on the shoulder 49 of the protective sleeve 46. Thus the end collar 43 is prevented from being pushed any further down by both the position of the bottom 50 of the shaft 45 and the holding pin 54 against the end collar 43.

To open the plug 13 the knob 44 is pulled in the direction shown by Arrow B in FIG. 2. This moves the holding pin 54 in the same direction and pulls in the end collar 43 and cable wire 40. The motion of cable wire 40 is transmitted to the second pin 34 of the retaining mechanism. The pin 34 is pulled back against the spring 37, compressing the fine spring 37. Once the second pin 34 is removed from the plug hole 26 the compressed spring 28 operates to push the plug 13 in the direction of Arrow C in FIG. 2. The upward motion of the plug 13 is arrested by part of the inter-engaging means, the first pin 31, resting against the bottom end of the slot 27. This is the open position shown in FIG. 3. Once the knob 44 is released, the second pin 34 rests with its curved end 36 touching against the exterior of the sides 21 of the plug 13.

The motion outward of the second pin 34 from the central axis of the plug 13 pushes the cable wire 40 back along the cabling 14 to push the end collar 43 within the cavity bore 51 of the knob 44 and shaft 45. Thus when the knob 44 is released, if it is on a vertical axis it can fall back under operation of gravity (arrow E, FIG. 3) to be flush with the base 48, whilst the end collar 43 sits within the bore 51.

The apparent "closed" nature of the knob 44 fulfils two purposes. Firstly it means a user of the basin is less likely to pull the knob 44, thinking this closes the plug 13. Secondly, in a "closed" position the knob 44 is less likely to allow water access to the mechanism of the opening unit 15.

The component parts of the sink waste unit 11 and plug 13 are preferably of metals such as brass, brass alloys, stainless steel, or other metals or alloys appropriate for use in bathroom/kitchen/waste fittings. Plastics materials may be used however if so desired.

The material or surface finish of the drain flange 16, plug top 20, knob 44 and flange 17 may be selected for visual appeal and a good finished appearance. If so desired, a shallow depression (for example, thumb sized) may be shaped into the top 20 of the plug 13. Preferably this is positioned on the top 20 immediately over the slot 27.

The above invention has been described with reference to a knob 44 which is pulled by hand and has an axis which is vertically aligned. However, it will be appreciated that this knob 44 may equally be a stirrup or handle that can be pulled other than by hand and which may be oriented other than vertically. For example, the remote opening unit may be positioned on the floor with a stirrup in place of the knob 44, which stirrup may be operated by foot. The knob 44 may be appropriately shaped so that it may be operated by other parts of the human body (for example, teeth). Also, if so desired, the knob 44 could be arranged, with appropriate levers, to be pushed rather than pulled, to open the plug 13.

Figure 4:
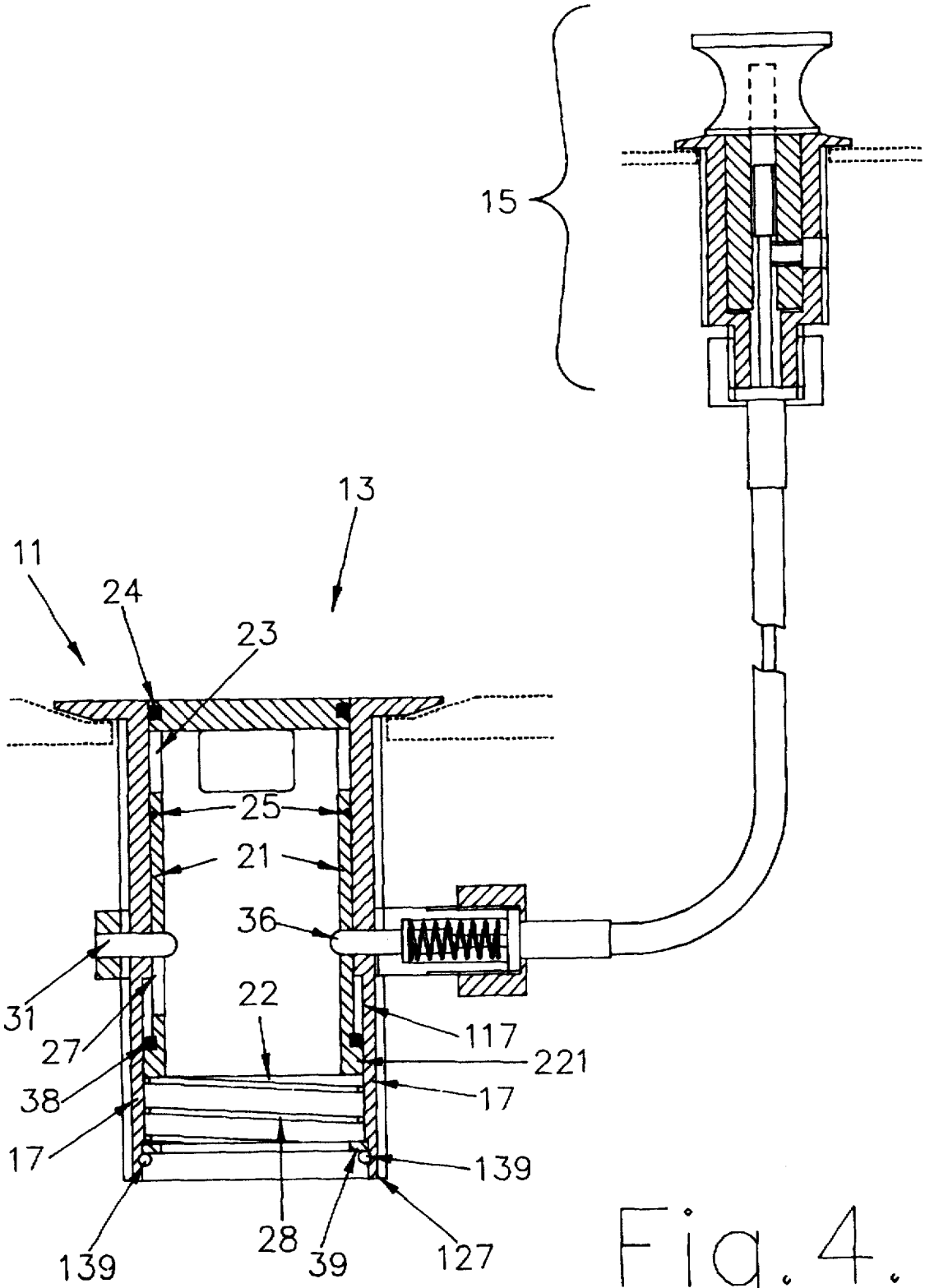
FIG. 4 is a section view of the present invention showing a second preferred embodiment of the drain and plug.
Figure 5:
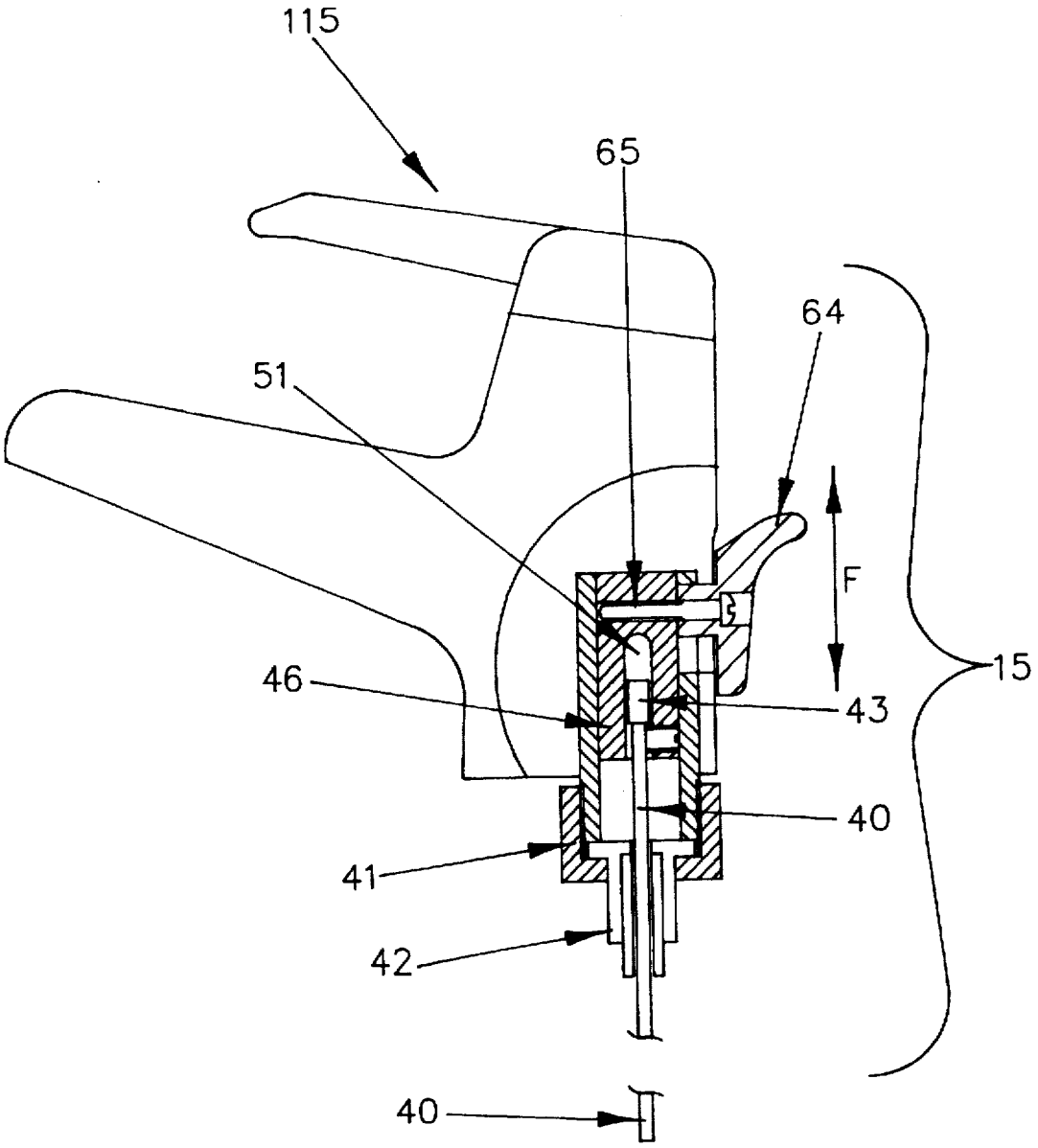
FIG. 5 is a partial section view of a tap unit incorporating a second preferred embodiment of the remote opening unit.

A second preferred embodiment of the sink waste unit 11 and plug 13 is shown in FIGS. 4 and 5. Like parts retain the original numbering. The modification to the plug 13 from the first preferred embodiment is mainly in the manner of securing the spring 28 within the sink waste unit 11 and cylindrical sides 17. The cylindrical sides 17 are stepped so that there is a shoulder 117 with a diameter greater than the internal diameter of the cylindrical sides 17 with a further step 127 at the very bottom of the sides 17, which again is greater in diameter. The sides 21 incorporate a flange 221 facing outwards at the bottom 22, but dimensioned to fit within the sides 17 of the sink waste unit 11.

An O-ring 38 is positioned adjacent the bottom of the sides 21 on the exterior thereof. The positioning of the O-ring 38 and the shoulder 117 are such that the two inter-engage when the plug 13 is in the open position (FIG. 3).

The spring 28 is retained in position at the bottom of the sink waste unit 11 by an annular collar 39 and split-ring 139 which are positioned and interact with the second stepped shoulder 127. The split-ring 139 and collar 39 can be inserted and removed manually in order to gain access to the spring 28. The plug 13 can be removed from the sink waste unit 11 for manual inspection, cleaning, or replacement of damaged or worn parts, by the above action and also removal of the pin 31 from the plug 13 and drain sides 17.

Referring to FIG. 5 a second preferred embodiment of the remote opening unit 15 is thereshown. Parts which are the same as the first preferred embodiment are shown in the same numerals. In the second preferred embodiment the remote opening unit 15 forms part of the back of a free standing tap 115, for example the type which incorporates both hot and cold water controls in the one lever. The knob 44 used to release the plug 13 in the first preferred embodiment is replaced by a sliding lever 64 shaped to be operated by a finger or thumb. This lever 64 moves up and down in the direction indicated by arrow F. The unit 15 operates in the same manner as that described above. The sliding lever 64 is secured to the remote opening unit 15 by a screw 65 which releasably secures the lever 64 to the protective sleeve 46. The interior bore 51 of the interior of the remote opening unit 15 is used in the same manner as described above. In the positioning of the remote opening unit 15 shown in FIG. 5 the operation (of the lever 64) is at the same point as knob 44 in FIG. 3.

Figures 6, 7:
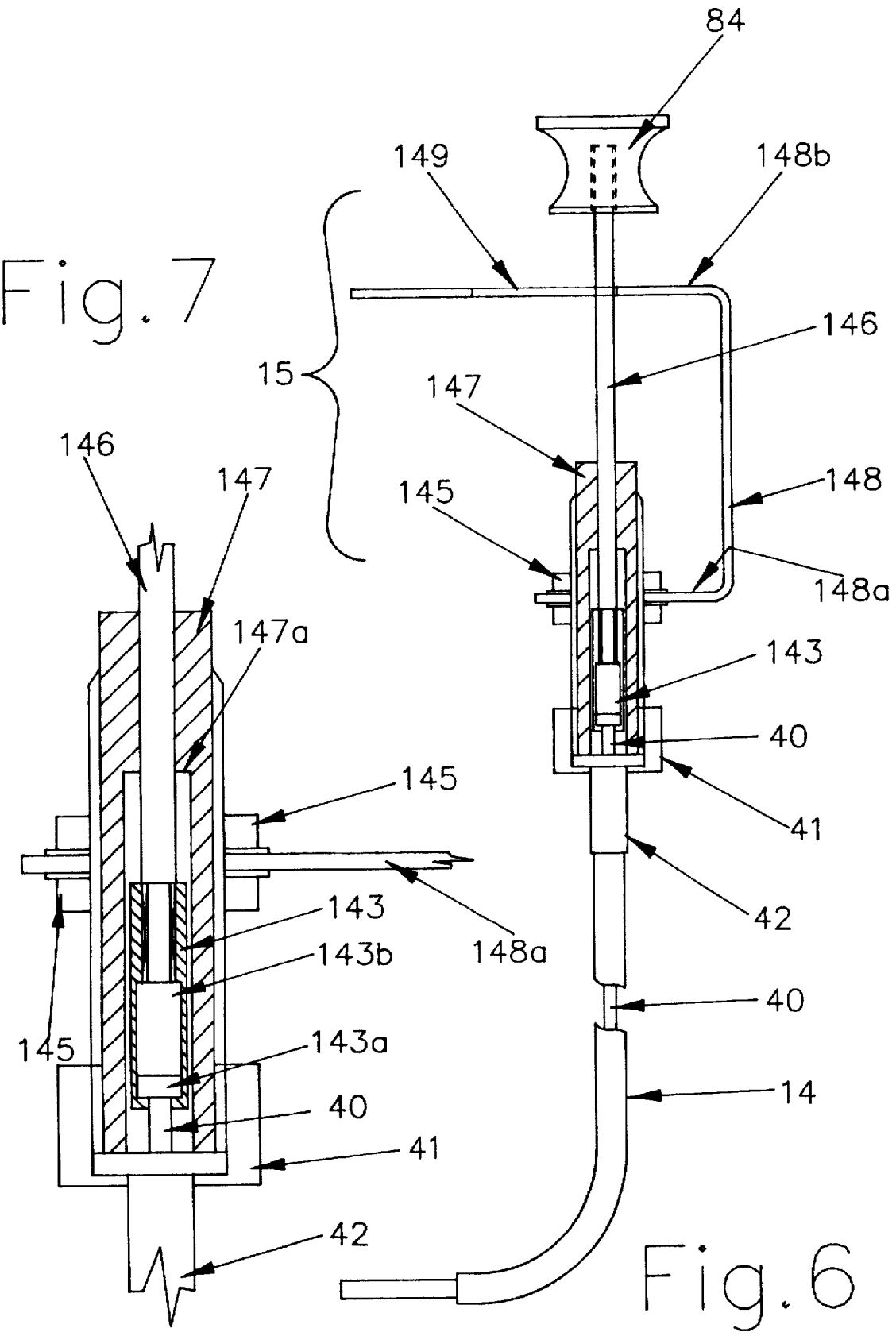
FIG. 6 is a section view of a third preferred embodiment of the remote opening unit of the present invention.
FIG. 7 is an enlarged view of the mechanism shown in FIG. 6.

Referring to FIGS. 6 and 7 a third preferred embodiment of the remote opening unit 15 is thereshown. The remote opening unit 15 is shown with attendant cable wire 40, incorporated in cabling 14, which is secured to the opening unit 15 through a nut 41, sleeve 42 and within an end collar 143. The end of the cable 40 is secured (for example by welding or soldering) to a cylindrical collar **143*a*. The dimensions of the interior of the end collar chamber 143*b* are such that the collar 143*a* can slide up and down within the end collar chamber 143*b* over a limited distance. The end of the cable 40 may be secured within the end collar chamber 143*b* by other means to prevent it from falling out of the end collar chamber 143*b***, for example by crimping, as is desired.

The second end of the end collar chamber 143 is screw threaded on the interior. A shaft 146 is screw threaded at one end to engage with the interior screw threading of the end collar 143. The second end of the shaft 146 is secured to, or integrally formed with, a hand knob 84 (performing the same function as hand knob 44).

The end collar 143 and one end of the shaft 146 are located within a sleeve 147. The interior of the sleeve 147 is hollow and stepped so that a shoulder **147*a* is formed approximately one third of the way down the interior of the sleeve 147. The shoulder 147*a* acts as a stop for the upward motion of the end collar 143 and is positioned along the length of the sleeve 147 to allow sufficient travel for the end collar 143 to permit the proper operation (as previously described) of the cable 40. The top portion of the interior of the sleeve 147 is a sliding fit about the shaft 146 so that the shaft 146 slides easily within the sleeve 147** but without sideways movement.

The exterior of the sleeve 147 is screw threaded. The nut 41 is attached to the bottom of the sleeve 147. The sleeve 147 is secured to one flange **148*a* of a bracket 148 by two nuts 145, one on each side of said flange 148*a*. The bracket 148 has a second flange 148*b*** spaced apart therefrom but approximately parallel thereto.

The shaft 146 extends through an opening 149 in the second flange **148*b*. The opening 149 is of sufficient size and shape that the hidden parts of a tap (not shown) (that is the parts of a tap below the (not shown) top surface of a sink or basin) may be inserted through the second flange 148*b*. Thus the shaft 146 may be inserted within and through the body of a tap. Thus the shaft 146 and the hand knob 84 have the appearance of forming an integral part of the tap (although the knob 84 and shaft 146** may not necessarily be integrally formed with the tap).

The distance between the first and second flanges 148 (*a* and *b*) may be adjusted to suit the particular model of basin or sink with which the remotely operated plug 13 and opening unit 15 is used. This selection of basin or sink will predicate the thickness of the basin (between the underside of the basin to the top of the basin at the point of placement of a tap). This thickness is adjustably allowed for with the threaded nuts 145, which permit the adjustment of the position of the end collar 143 relative to the second flange **148*b***.

The bracket 148 is held in position by the manner of securement of the sleeve 147 thereto and the securement of the shaft 146 within the tap secured to the sink or basin. The bracket 148 may be machined, stamped, bent and/or welded; and further may include cut away portions where there is non-essential material to the function of the bracket 148. Alternatively, if so desired, the two flanges 148 (*a* and *b*) may be separated but secured together by two or more rods of material (in place of the side walls of the bracket 148).

The bracket 148 can be made of any appropriate material, for example aluminium, a rigid plastics material or other machinable material of sufficient strength to support said opening unit 15 when the unit is in operation.

The above described third preferred embodiment of the remote opening unit 15 works as follows: the cable 40 is attached to the plug 13 as previously described. When a user desires to open the plug 13 the hand knob 84 is pulled upwards. This in turns pulls up the shaft 146, end collar 143 and connected cable 40. This releases the mechanism holding open the plug 13. The knob 84 falls back to the lower position, when released.

Figure 8:
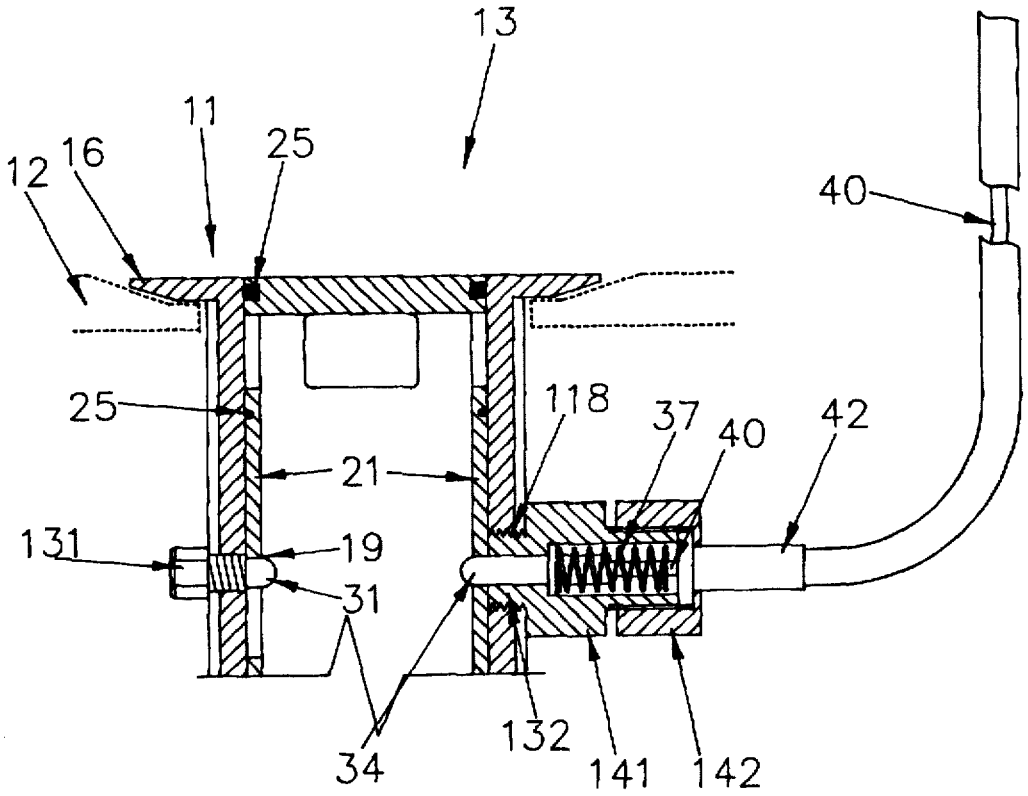
FIG. 8 is a partial cross section of a third preferred embodiment of the drain and plug unit.

Referring to FIG. 8 a third preferred embodiment of the sink waste unit 11 and plug 13 is thereshown. The plug 13 includes sides 21 in which are two circular holes, first and second holes 19, 118. The second hole 118 is of a larger size than the first hole 19. Both holes (19, 118) are screw-threaded and hole 19 receives therethrough a complementary screw threaded metal pin head 31 with an exterior knob 131. The exterior knob 131 is shaped for ease of operation of the pin for insertion and removal of the pin head 31 into the hole 19. The knob 131 and pin head 31 can be formed integrally, if so desired.

The hole 118, being larger in size than the hole 19, is also screw threaded and receives therein an externally screw threaded collar 132. The collar 132 is formed integrally with or permanently secured to a nut 141. Both the collar 132 and nut 141 are hollow internally to receive therethrough the second pin 34. An additional end collar 142 (threaded onto nut 141) replaces and serves the same function as the nut 41 (in the first preferred embodiment) in securing the spring 37 and permitting its operation. The chamber 33 and flanged end 35 remain unchanged from the first preferred embodiment. The end 36 of the pin 34, when in the extended position (when the plug 13 is closed), protrudes slightly into the plug 13. The spring 37 operates against the flanged end 35 of the pin 34. The cable wire 40 is secured by the nut 141 and nut 142 to the exterior side 17 of the sink waste unit 11. The cable 40 and end of the cable operate in the same manner as described above.

The space 131 and nuts 141 and 142 can be made from any metal but are preferably brass, brass alloys or stainless steel. Plastics fittings of appropriate grade could also be used.

Thus the described improvements operate in place of the collar 29 of the first preferred embodiment such that minor modification to an existing sink waste unit 11 is the only modification that need to be made to a commercial drain unit, for the installation of the above described, remotely operated plug 13.

A further preferred modification to the plug 13 is to the slot 27. In the first preferred embodiment (FIG. 2 and 3) this slot 27 terminated at a point adjacent the bottom 22 of the plug 13. Thus if the plug 13 was to be physically removed from the sink waste unit 11, the pins 31 and 34 need to be released/removed from the plug 13 at the same time. This forms a means for enabling the plug 13 to be removed from the sink waste unit 11.

The further preferred modification to the plug 13 is to add a second, offset slot (not shown) beside and adjacent and touching the slot 27. The second slot would be open to the bottom 22 of the plug 13. Thus a dog-leg slot would result.

Operation of the plug 13 to close the plug 13 would be as described above. However if the plug 13 is to be removed, the plug 13 is rotated (with the second pin 34 withdrawn from hole 18) so that the first pin 31 can move along the second offset slot to allow the plug 13 to be completely removed from the sink waste unit 11 (from above).

Reversing the action of the plug 13 would re-inset the plug 13 in the sink waste unit 11 and the pin 34 being released once the pin 31 was aligned with the slot 27 would re-locate the plug 13 in the proper position for operation.

We claim:

1. A remotely operated plug assembly for a sink or basin with a drain, said plug assembly including:

a sink waste unit secured within said drain, which sink waste unit includes a drain pipe;

a plug movably and releasably secured within said drain, said plug including a spring and an inter-engaging means, said plug having a closed top and sides with holes formed therein, wherein said plug is movably secured within the drain by said inter-engaging means which permits vertical movement of said plug within said drain, between an open and a closed position (and vice versa), but which does not permit the removal of said plug from said drain under normal operating conditions, and said spring being to bias said plug to the open position, said open positing being a position in which said holes are open to said sink or basin, and said closed position being a position in which said closed top is substantially flush with the top of said sink waste unit;

an opening mechanism to move the plug from the closed position to the open position, said mechanism being situated remotely from said drain and plug and connected by cabling to a retaining mechanism, said opening mechanism including an opening means to move and retain one end of said cabling;

the retaining mechanism, to keep said plug in the closed position, includes spring-biassed means to release said retaining mechanism to allow said plug to move to the open position;

means to allow the plug to be physically removed from said drain and replaced therein; and wherein said plug is capable of movement between the open and the closed positions by manual depression of said plug, and between the closed and the open positions by operation of said remotely placed opening mechanism to release the retaining mechanism via the cabling; and wherein said inter-engaging means, and the elements of said retaining mechanism being circumferentially positioned about said drain and plug and peripherally around said drain pipe.

2. A remotely operated plug assembly as claimed in claim 1 wherein said interengaging means includes:

a locating hole through the side of said plug and a slot through the side of said plug opposite or spaced apart from said locating hole, said slot being positioned in the lower half of said plug, the lower end of said slot being adjacent the lower end of said plug;

a pair of locating holes comprising a third and fourth locating hole, said pair being positioned on and through said drain pipe such that when said plug is in a closed position the first and third locating holes are aligned and the second locating hole and slot are aligned;

a fixed pin capable of location through said second locating hole and slot; and a movable pin capable of location through said first and third locating holes; and wherein said movable pin is connected to one end of said cabling.

3. A remotely operated plug assembly as claimed in claim 2 wherein said movable pin is spring biassed by the spring biassed means of the retaining mechanism, which mechanism includes a second spring to an extended position in which said movable pin extends through said first and third locating holes when said plug is in the closed position.

4. A remotely operated plug assembly as claimed in claim 2 wherein said fixed and said movable pins and the said one end of the cabling are retained in position relative to the drain pipe within a rigid collar positioned around said drain pipe.

5. A remotely operated plug assembly as claimed in claim 2 wherein said fixed pin is retained in position relative to said drain pipe by retaining means with which it is integrally formed, and said movable pin is retained in position relative to said drain pipe by a separate retaining means which is releasably secured to said drain pipe.

6. A remotely operated plug assembly as claimed in claim 5 wherein said opening mechanism includes:

an actuator with an attached hollow shaft, said shaft being slidable within a chamber formed in a protective sleeve positioned about said hollow shaft, said actuator having a space therein aligned with the hollow through said shaft;

a nut capable of being screw-threaded onto one end of the protective sleeve, said sleeve being positioned about said hollow shaft;

an end collar rigidly secured to the second end of said cabling, said collar being retained within the space formed by the actuator hollow, hollow shaft and protective sleeve;

a retaining pin positioned within a transverse channel within a wall of said hollow shaft, said pin protruding into said space; wherein said end collar is of sufficient size to prevent said second end of the cabling from passing through said nut; and wherein said retaining pin causes said end collar to move in an upwards direction when said actuator is so pulled, thus releasing said retaining mechanism.

7. A remotely operated plug assembly as claimed in claim 5 wherein said opening mechanism includes:

an actuator with an attached hollow shaft, said shaft being slidable within a chamber formed in a protective sleeve positioned partly about said hollow shaft, said actuator being slidably engaged with a tap secured to said sink;

a nut capable of being screw-threaded onto one end of the protective sleeve, said sleeve being positioned partly about said hollow shaft and also partly within and under said tap;

an end collar rigidly secured to the second end of said cabling, said collar being retained within the space formed by the actuator, the hollow shaft and protective sleeve;

a retaining pin positioned within a transverse channel within a wall of said hollow shaft, said pin protruding into said space; wherein said end collar is of sufficient size to prevent said second end of the cabling from passing through said nut; and wherein said retaining pin causes said end collar to move in an upward direction when said actuator is so pulled relative to said tap, thus releasing said retaining mechanism.

8. A remotely operated plug assembly as claimed in claim 5 wherein said opening mechanism includes:

an actuator rigidly secured to one end of a shaft;

a chamber formed in a protective sleeve within which the second end of said shaft is located;

a nut capable of being screw-threaded onto one end of said protective sleeve;

an end collar rigidly secured to the second end of said cabling, said collar being retained within the protective sleeve, said end collar being of sufficient size to prevent said second end of the cabling from passing through said nut; wherein said protective sleeve is chambered to retain said end collar therein and said sleeve is secured, in a fixed position relative to but spaced a part from said sink, by a bracketing means and wherein the shape of the chambered protective sleeve is such that movement of the actuator, pulling the second end of said cabling, thus releases said retaining mechanism.

9. A remotely operated plug assembly as claimed in claim 1 wherein said spring is retained in position by a flange positioned adjacent the bottom of the drain on the inside, said flange being formed integrally with said drain.

10. A remotely operated plug assembly as claimed in claim 1 wherein said assembly is made from materials selected from the group consisting of aluminium, aluminium alloy, brass, steel, stainless steel, other metals, other metal alloys, a rigid plastics material, and any combination thereof.

11. A remotely operated plug assembly as claimed in claim 1 wherein said plug unit includes two O-rings positioned one above and one below said holes, and within a respective groove, wherein said lower O-ring is not visible when said plug is in the open position and wherein each said O-rings provides a seal between said plug and said drain.

12. A remotely operated plug assembly as claimed in claim 1 wherein said cabling, between said opening mechanism and said retaining mechanism, is contained within a protective sheath within which said cabling is slidable.

13. A remotely operated plug assembly as claimed in claim 1 wherein said opening mechanism includes:

an actuator with an attached hollow shaft, said shaft being slidable within a chamber formed in a protective sleeve positioned about said hollow shaft, said actuator having a space therein aligned with the hollow through said shaft;

a nut capable of being screw-threaded onto one end of the protective sleeve, said sleeve being positioned about said hollow shaft;

an end collar rigidly secured to the second end of said cabling, said collar being retained within the space formed by the actuator hollow, hollow shaft and protective sleeve;

a retaining pin positioned within a transverse channel within a wall of said hollow shaft, said pin protruding into said space; wherein said end collar is of sufficient size to prevent said second end of the cabling from passing through said nut; and wherein said retaining pin causes said end collar to move in an upwards direction when said actuator is so pulled, thus releasing said retaining mechanism.

14. A remotely operated plug assembly as claimed in claim 1 wherein said opening mechanism includes:

an actuator with an attached hollow shaft, said shaft being slidable within a chamber formed in a protective sleeve positioned partly about said hollow shaft, said actuator being slidably engaged with a tap secured to said sink;

a nut capable of being screw-threaded onto one end of the protective sleeve, said sleeve being positioned partly about said hollow shaft and also partly within and under said tap;

an end collar rigidly secured to the second end of said cabling, said collar being retained within the space formed by the actuator, the hollow shaft and protective sleeve;

a retaining pin positioned within a transverse channel within a wall of said hollow shaft, said pin protruding into said space; wherein said end collar is of sufficient size to prevent said second end of the cabling from passing through said nut; and wherein said retaining pin causes said end collar to move in an upward direction when said actuator is so pulled relative to said tap, thus releasing said retaining mechanism.

15. A remotely operated plug assembly as claimed in claim 1 wherein said opening mechanism includes:

an actuator rigidly secured to one end of a shaft;

a chamber formed in a protective sleeve within which the second end of said shaft is located;

a nut capable of being screw-threaded onto one end of said protective sleeve;

an end collar rigidly secured to the second end of said cabling, said collar being retained within the protective sleeve, said end collar being of sufficient size to prevent said second end of the cabling from passing through said nut; wherein said protective sleeve is chambered to retain said end collar therein and said sleeve is secured, in a fixed position relative to but spaced a part from said sink, by a bracketing means and wherein the shape of the chambered protective sleeve is such that movement of the actuator, pulling the second end of said cabling, thus releases said retaining mechanism.

16. A remotely operated plug for a sink or basin with a drain and a drain pipe, wherein said plug includes:

being movably and releasably secured within said drain, said plug having a closed top and sides with holes formed therein, said plug being movably secured within the drain by an inter-engaging means which permits vertical movement of said plug within said drain, between an open and a closed position (and vice versa), but which does not permit the removal of said plug from said drain under normal operating conditions and which incorporates a spring to bias said plug to the open position, said open position being a position in which said holes are open to said sink or basin, and said closed position being a position in which said closed top is substantially flush with the top of said sink waste unit;

said plug being connected to an opening mechanism situated remotely from said drain and plug and connected by cabling to a retaining mechanism, said opening mechanism including an opening means to move and retain one end of said cabling;

the retaining mechanism, to keep said plug in the closed position, including spring-biassed means to release said retaining mechanism to allow said plug to move to the open position;

said plug including means for enabling the plug to be physically removed from said drain and replaced therein; and wherein said plug is capable of movement between the open and the closed positions by manual depression of said plug, and between the closed and the open positions by operation of said remotely placed opening mechanism to release the retaining mechanism via the cabling; and wherein said inter-engaging means, and the elements of said retaining mechanism are circumferentially situated about said drain pipe and plug, and peripherally around said.

* * * * *